US006121534A

United States Patent [19]

Brush

[11] Patent Number: 6,121,534

[45] Date of Patent: Sep. 19, 2000

[54] NATURAL-SCALE TONE-GENERATOR APPARATUS FOR MIDI MUSICAL KEYBOARDS

[76] Inventor: Gary T. Brush, P.O. Box 2147, Sault Ste. Marie, Mich. 49783

[21] Appl. No.: 09/370,971

[22] Filed: Aug. 9, 1999

[51] Int. Cl.[7] ..... G10H 5/06

[52] U.S. Cl. ..... 84/617; 645/682; 645/451; 645/454; 645/DIG. 18

[58] Field of Search ..... 84/617, 645, 655, 84/672–677, 682, 716, 638, 451, DIG. 11, 454, DIG. 18

[56] References Cited

U.S. PATENT DOCUMENTS 4,063,484 12/1977 Robinson ..... 84/675
5,306,865 4/1994 Dinnan et al. ..... 84/451 X
5,502,274 3/1996 Hotz ..... 84/645 X
5,841,053 11/1998 Johnson et al. ..... 84/645 X

*Primary Examiner*—Stanley J. Witkowski

[57] ABSTRACT

After centuries of compromise and frustration, the unacceptable distortion created by equal-tempered-scale tuning can finally be eliminated and a musical keyboard instrument will be able to produce perfect harmony in any playing key. The invention is a natural-scale tone-generator apparatus, which requires a conventional MIDI keyboard to transmit key selection as a binary input signal, and a conventional stereo system for sound output. The invention uses a digitally-controlled, phase-locked-loop circuit as an independent tone generator for each note and a unique programming method to change tempered-scale tuning and create the rich tones of the natural scale according to key selection. The MIDI binary code and programming method is formatted for an organ-kit assembly layout and is explained in Motorola flowchart-symbolic language suitable for keyboard hobbyists and experimenters.

10 Claims, 4 Drawing Sheets

NATURAL-SCALE TONE-GENERATOR APPARATUS FOR MIDI MUSICAL KEYBOARDS

BACKGROUND OF THE INVENTION

This invention relates to the field of electronic apparatus for musical keyboards and specifically to the creation of a tone-generator apparatus and programming method for tuning key selection to the natural scale.

The natural-scale tone-generator apparatus and programming method described herein is designed to create perfect keyboard harmony in any playing key and eliminate the unacceptable distortion created by equal temperament tuning.

The equal-tempered music scale, also called the scale of equal temperment, and more commonly, the tempered scale, was introduced over two hundred years ago to allow fixed-tone instruments such as a piano or an organ to be played in any key by compromising the unequal intervals of the natural scale.

Table 1 on Page 5 compares interval frequencies for one octave of an equal tempered scale of A with the corresponding natural scale of A Major. The column headings of Table 1 are explained as follows:

- The "Key" column is for the decimal key number of the tempered-scale and natural-scale frequencies according to a MIDI keyboard Specification.
- The "Note" column is for the name of the note corresponding to the tempered-scale and natural-scale frequency.
- The "TS Hz" column is for the tempered-scale frequency in Hz.
- The "TS Formula" column shows how tempered-scale frequencies are formed by multiplying each successive frequency, starting with a 220.0 Hz reference note, by 1.0595 to get the next frequency.
- The "Interval" column shows the name of tempered-scale and natural-scale semitone intervals preceded by their program code numbers in decimal.
- The "NS Hz" column is for the natural-scale frequency in Hz.
- The "NS Formula" column shows how to calculate the natural-scale frequencies by starting with a reference frequency of 220 Hz for note A and multiplying it by unique whole-number ratios to get the frequencies of successive notes.
- The "E-T Error" column shows equal-tempered error in cents. One cent is a 1/100th part of the frequency difference from one semitone to another.

Table 1 permits detailed information about tempered-scale intervals and corresponding natural-scale intervals to be read directly from columns and rows. For example, the scale of A begins with a MIDI key number 57 for a note A and a frequency of 220 Hz, which is also the 1st interval and reference note for each scale and has a TS error of 0.

The next interval is a key number 58 for a note A# with a tempered-scale frequency of 233.1 Hz, calculated by multiplying 220 Hz by 1.0595. This is a Semitone interval and has a natural-scale frequency of 234.7 Hz, calculated by multiplying 220 Hz by a unique whole-number ratio, 16/15, which corresponds to a TS Error of −12 cents. Detailed information for all of the other intervals can be read directly from Table 1 in a similar manner.

In Table 1, the 1st, 2nd, 3rd, 4th, 5th, 6th, 7th, and 8th intervals refer to the original succession of two whole tones and a half tone followed by three whole tones and a half tone discovered by Pythagoras in the 6th century B.C. and called the diatonic or natural scale. The other semitone intervals were added to form the chromatic scale, which allows a musical scale to be started from any one of twelve semitone pitches identified by its key-signature note.

Table 1 shows that the equal-tempered scale is made up of 12 equal semitones to the octave making the frequency ratio of successive semitones the 12th root of 2 or 1:1.0595 approximately. A smaller factor, called the "cent" is used for tuning purposes and is defined as a 1/100th part of an equal-tempered semitone. Human hearing can detect a note that is out of tune within a few cents if there is another note or unison to compare it with. Distortion greater than 3 cents is noticeable to a trained ear.

In contrast with the uniform divisions of the equal-tempered scale, Table 1 shows that the natural scale is made up of a series of unequal semitone intervals created by small, whole-number ratios. These ratios were also discovered by the Greek philosopher, Pythagoras, which he calculated from the lengths of strings on musical instruments corresponding to the most pleasant sound combinations. They remain the basis of all harmony today.

Because the whole tones of the natural scale are unequal in size, the twelve musical scales starting with each semitone of the natural scale produce some notes that are too far out of tune for use in other playing keys. The tempered scale equalizes semitone sizes so that they can be used in all playing keys, but the distortion is still at an unacceptable level for nine of the twelve semitone intervals as shown in Table 1.

The key numbers in Table 1 are decimal values of MIDI hexadecimal key numbers used to identify key selection according to a binary code defined by the Musical Instrument Digital Interface Specification, which is more fully explained on Page 7. Commonly known as the MIDI Specification, a copy is available on the internet, in the MIDI literature of public libraries, by manufacturers, and in publications of music-trade magazines. An excellent reference for the mechanics of the musical scale is a book called PIANO TUNING and ALLIED ARTS, by William Braid White, Mus. D., and published by the TUNERS SUPPLY COMPANY of Boston, Mass.

The chord of A Major, which consists of the 1st, 3rd, and 5th intervals, can be used to illustrate the harmonic distortion created by the tempered scale. Table 1 shows that the natural-scale frequency of the 3rd interval, note C#, is 275.0 Hz and that the corresponding frequency in equal temperment is 277.2 Hz, which is 2.2 Hz higher than it should be. In equal temperment, the number of hertz from C# to C is 15.6 (277.2–261.6) making the 3rd interval 14 cents too sharp (100×2.2/15.6) as shown in the TS Error column.

The chord of A Minor 6th, which is made up of the 1st, Minor 3rd, 5th, and 6th intervals, is even more discordant. In equal temperment, Table 1 shows that notes C and F# are 32 cents out of tune with one another.

As it usually requires a 3rd or Minor 3rd interval to form a chord, it is thus apparent that all chords in equal temperment contain notes that can be out of tune up to 10 times the maximum tolerance level (3 cents) for good harmony.

TABLE 1

Comparative Frequencies of Equal Tempered Scale of A and Natural Scale of A Major with corresponding key, note, and interval identification. Table 1 also shows formulas for calculating frequencies and tempered scale error.

| Key | Note | TS Hz | TS Formula | Interval | NS Hz | NS Formula | TS Error |
|---|---|---|---|---|---|---|---|
| 57 | A | 220.0 | reference note | 0 1st | 220.0 | reference note | 0 Cents |
| 58 | A# | 233.1 | 220.0 × 1.0595 | 1 Semtone | 234.7 | 220 × 16/15 | −12 Cents |
| 59 | B | 246.9 | 233.1 × 1.0595 | 2 2nd | 247.5 | 220 × 9/8 | −4 Cents |
| 60 | C | 261.6 | 246.9 × 1.0595 | 3 Min 3rd | 264.0 | 220 × 6/5 | −16 Cents |
| 61 | C# | 277.2 | 261.6 × 1.0595 | 4 3rd | 275.0 | 220 × 5/4 | +14 Cents |
| 62 | D | 293.7 | 277.2 × 1.0595 | 5 4th | 293.3 | 220 × 4/3 | +2 Cents |
| 63 | D# | 311.1 | 293.7 × 1.0595 | 6 Dim 5th | 312.9 | 220 × 64/45 | −10 Cents |
| 64 | E | 329.6 | 311.1 × 1.0595 | 7 5th | 330.0 | 220 × 3/2 | −2 Cents |
| 65 | F | 349.2 | 329.6 × 1.0595 | 8 Min 6th | 352.0 | 220 × 8/5 | −14 Cents |
| 66 | F# | 370.0 | 349.2 × 1.0505 | 9 6th | 366.7 | 220 × 5/3 | +16 Cents |
| 67 | G | 392.0 | 370.0 × 1.0595 | 10 Min 7th | 391.1 | 220 × 16/9 | +4 Cents |
| 68 | G# | 415.3 | 392.0 × 1.0595 | 11 7th | 412.2 | 220 × 15/8 | +12 Cents |
| 69 | A | 440.0 | 415.3 × 1.0595 | 0 8th | 440.0 | 220 × 2/1 | 0 Cents |

As well as having whole tones of unequal size, it is also true that natural scale octaves derived by the circle-of-fifths method of Pythagoras are not exact multiples of each other. The invention solves these problems by using the tempered scale as a reference to keep octaves coincident and tuning corrections equal for the same interval in each of the 12 semitone playing keys.

A unique sequence of computer-program steps can then reduce key selection to intervals of one octave and correct tone-generator apparatus from the tempered scale to the natural scale with a simple look-up table of 12 correction codes.

The invention apparatus is therefore connected to get key selection data from the binary code of a MIDI keyboard or key sequencer and to control tuning of tone generator apparatus with a computer and computer program.

The tuning program makes an on-going, note-on list of key selection. The list is then converted to intervals of one octave for tuning-code identification. The first note in the list then becomes the root position or tempered-scale reference for correcting the rest of the notes in the list to the natural scale. For non-percussive organ voicing, which does not require velocity values, the program substitutes tuning-correction codes for key-velocity values in the MIDI binary code before outputting each note-on key-selection list. As an optional program feature, correction from a current root position could continue as long as the first note in the list is held on. A full explanation of program procedures by flowchart steps are included in the specification.

Perfect tuning is possible using the tempered scale as a reference because, even though the tempered-scale reference frequency may vary from true pitch as much as sixteen cents, it forms the root position for each corrected note and no distortion is detected. As previously stated, without making a comparison, the human ear can't pinpoint a pitch difference, and chords with melody notes are always selected in one semitone playing key at a time.

Tones will sound richer, more spontaneous, and alive with natural-scale corrections constantly changing tempered-scale tuning. The programming method could also be used to access correctly tuned notes of digital algorithms and recordings for more harmonious and less monotonous performance.

In the past, the best tone generators for electronic musical keyboards were assembled from discrete transistor components and associated hardware. Tuning was fixed and was adjusted by turning a slug in a shielded feedback coil. These tone generators, although excellent, were bulky and expensive.

Presently, high global production and the lower cost of semiconductors make phase-locked-loops such as the 567 especially attractive as voltage-controllable oscillators for musical tone generators. These popular integrated circuits are used in many critical-performance applications. As an array of tone generators, they do not interfere with one another and tuning can be controlled by switching voltages digitally with the natural-scale tone-generator program and apparatus.

With the introduction of digital recordings for musical keyboards, it was originally thought that keyboards with live tone generators, such as acoustic strings and electronic oscillators, would soon be a thing of the past. Instead, digital technology would allow computers to generate low cost recordings of musical instrument sounds for keyboard selection. However, after hearing and assessing digitally-recorded keyboard sounds for many years, audiences still prefer a skilled performance on a live instrument and musicians realize that live instruments will always be necessary to develop and maintain musical skills.

Digital music technology has spurred mass production of low cost musical keyboards that can transmit key selection on and off data by means of the MIDI binary code. This information can be stored by computer sound cards for key replay. The natural-scale tone-generator apparatus can be connected to the MIDI output of any MIDI keyboard or sound card as a source of key selection. The MIDI binary code is derived from the MIDI specification and is an internationally accepted binary code for transmitting and receiving key selection and control information. All MIDI communication is propagated by means of multibyte commands consisting of a Status byte followed by one or two Data bytes.

The Status byte is an 8-bit binary number with a most significant bit of one. It serves to define the purpose of the Data bytes that follow the Status byte. There are several kinds of Status bytes in a MIDI transmission and key selection only requires Note-On Status commands to be sorted out for processing.

Data bytes are 8-bit binary numbers with a most significant bit of zero. There are at least two Data bytes following a Note-On command. They identify the key number and key velocity. A key velocity of zero is a Note-Off command. When a Status byte is sent, the receiver remains in that status until a different Status byte is sent. This is called a Running Status and allows long strings of note On-Off messages with only the correct number of Data bytes necessary for transmission or reception. A copy of the MIDI 1.0 Specification is included in books such as MIND OVER MIDI, by the editors of Keyboard Magazine, published by Hal Leonard Corporation, 7777 West Bluemound Rd, Milwaukee, Wis. 53213.

BRIEF SUMMARY OF THE INVENTION

The object of the invention is to create the beautiful harmony of the natural scale with a musical keyboard instrument. The invention makes keyboard performance sound more spontaneous with at least one, independently tuned, tone generator for each note and natural-scale tuning corrections that constantly change keyboard tuning in contrast to the discord of tempered-scale key selection and the monotony of fixed-tone digital recordings thereof. A computer program is used to change key-selection tuning of each tone generator, which is a digitally-controlled phase-locked-loop integrated circuit.

The invention addresses the problems of natural-scale interval ratios producing unequal whole tones with corresponding notes that are too discordant for other playing keys, and natural-scale octaves that are not exact multiples of each other. To solve these problems, the invention uses the tempered scale as a reference to correct tuning to the natural scale.

The tone-generator apparatus is designed to be part of a component system so that the binary output of any MIDI keyboard can be used as an input, and for any good quality audio amplifier and speaker system to be used as an output.

DETAILED DESCRIPTION OF THE INVENTION

To emphasize the rich harmony of natural-scale tuning, the apparatus of the invention is shown in a non-percussive, key-selection embodiment, controlling the steady tones of full-organ voicing circuitry.

All hexadecimal numbers in the specification carry a $ prefix unless otherwise identified. All intersecting lines in drawings do not connect unless a dot is shown at the intersection. All components of the subject invention are standard units which are conveniently available to persons versed in the art and are used in numerous applications. Persons versed in the art will recognize the various components and realize that other components could be substituted so long as they have similar functions while still accomplishing the same result as the subject invention, thus without departing from the spirit of the invention.

Figure 1:
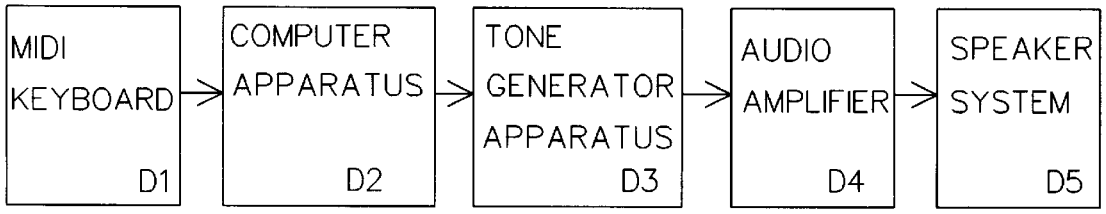
FIG. 1 is a block diagram of apparatus to practice the subject invention.

In FIG. 1, a conventional MIDI keyboard, shown as a block D1, sends a MIDI binary code corresponding to the operation of the keyboard to a block D2. In block D2 the binary code is loaded into the program of a microcomputer apparatus. A microcomputer is defined as a home computer or general-purpose data processor. The program sorts out key-selection numbers and respective velocity values from the binary code. Key numbers with zero-velocity values are note-off commands. Key numbers with greater than zero-velocity values are interpreted as note-on commands. The program uses the key numbers to operate microcomputer output apparatus to control tone-generator voicing apparatus in a block D3.

The program uses tuning-correction codes to correct tone-generator tuning apparatus in block D3. The tone-generator apparatus of block D3 contains a tone generator for each note with a respective tuning and a respective voicing apparatus for each tone generator. The tone generators are on all the time. The program turns keys on and off by turning the respective voicing apparatus for the notes on and off. Tuning corrections are made as the keys are selected on.

The sound output of the voicing apparatus in block D3 is sent to a conventional audio amplifier in a block D4. The amplifier is connected to a conventional speaker system represented by a block D5. For a conventional stereo amplifier and speaker system, the sound output for low notes can be sent to one channel and the sound output for high notes can be sent to another channel.

Figure 2:
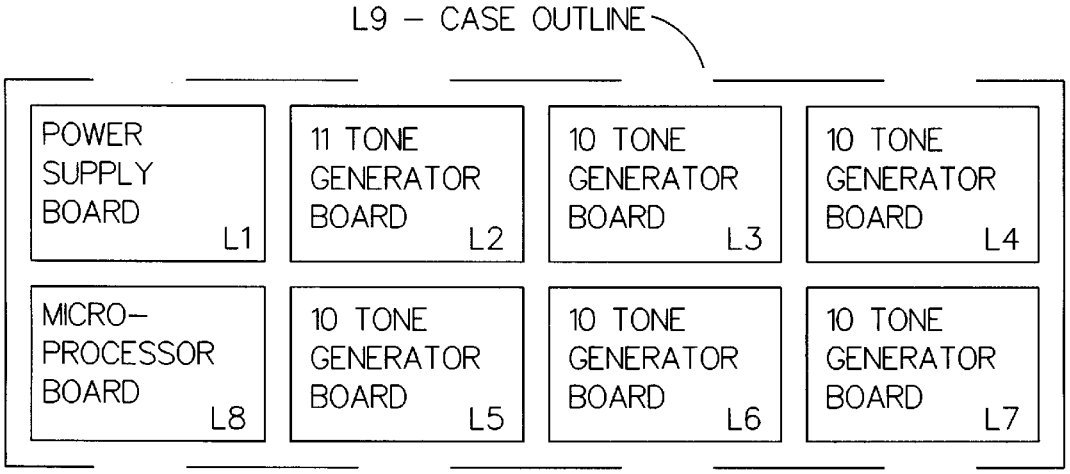
FIG. 2 shows the circuit-board layout of the subject invention.

FIG. 2 shows a circuit-board layout of the invention apparatus. It consists of eight printed-circuit boards, identified as L1 to L8. The circuit boards are approximately 9 by 6 inches in size and are laid out lengthwise in two rows. The overall dimensions for a case outline L9 is about 15 by 41 inches and requires a height of about 3½ to 4 inches for a case enclosure. The enclosure is made of wood or plastic and has a removeable lid for tuning or service.

A board L1 is a conventional power supply purchased from any commercial supplier such as Digi-Key Corporation at www.digikey.com or it can consist of discrete voltage-regulator parts mounted on a printed-circuit board and attached to a conventional wall transformer purchased from the same supplier. The power supply draws about 400 to 500 milliamperes of current at +5 volts for all apparatus except the summing amplifiers of the voicing circuits, which require minimum supply voltages of +5 and −5 volts from an additional 100 milliampere source in the supply. The +5 volt supply voltage should be well regulated to meet specifications similar to a type 317 voltage regulator integrated circuit, and for best results should be over rated to handle at least one ampere of current.

In FIG. 2, a board L2 has 11 tone generators, and a board L3, L4, L5, L6, and L7, each have 10 tone generators to correspond to a 61 note keyboard. The respective tuning and voicing apparatus for each note is also located with the respective tone generator on each board.

Tone generator tuning ranges from a note C for key number 36 with a frequency of 65.4 Hz to a note C for key number 96 with a frequency of 2093 Hz. The MIDI specification recognizes 128 notes, also called key numbers, from 0 to 127 so that the tuning range can be changed and the program modified accordingly.

A board L8 is a microcomputer-apparatus board with a key-selection matrix for 61 notes. Each note of the matrix has a respective flip-flop-latch connection to the voicing apparatus of each tone generator on boards L2 to L7 inclusive. The microcomputer of board L8 also has data-bus connections to the tuning apparatus of each tone generator on boards L2 to L7 inclusive.

The power supply L1 is connected to a ground terminal and a power terminal on L2 to L8 inclusive. Power supply connections are not shown on drawings as this information is a matter of commercial production-design preferences for persons versed in the art. However, an etched-copper layout, similar to FIG. 2 and with all required connections, will be made available for hobbyists at the inventor's website featuring optional 8-note circuit boards for easy assembly.

Figure 3A:
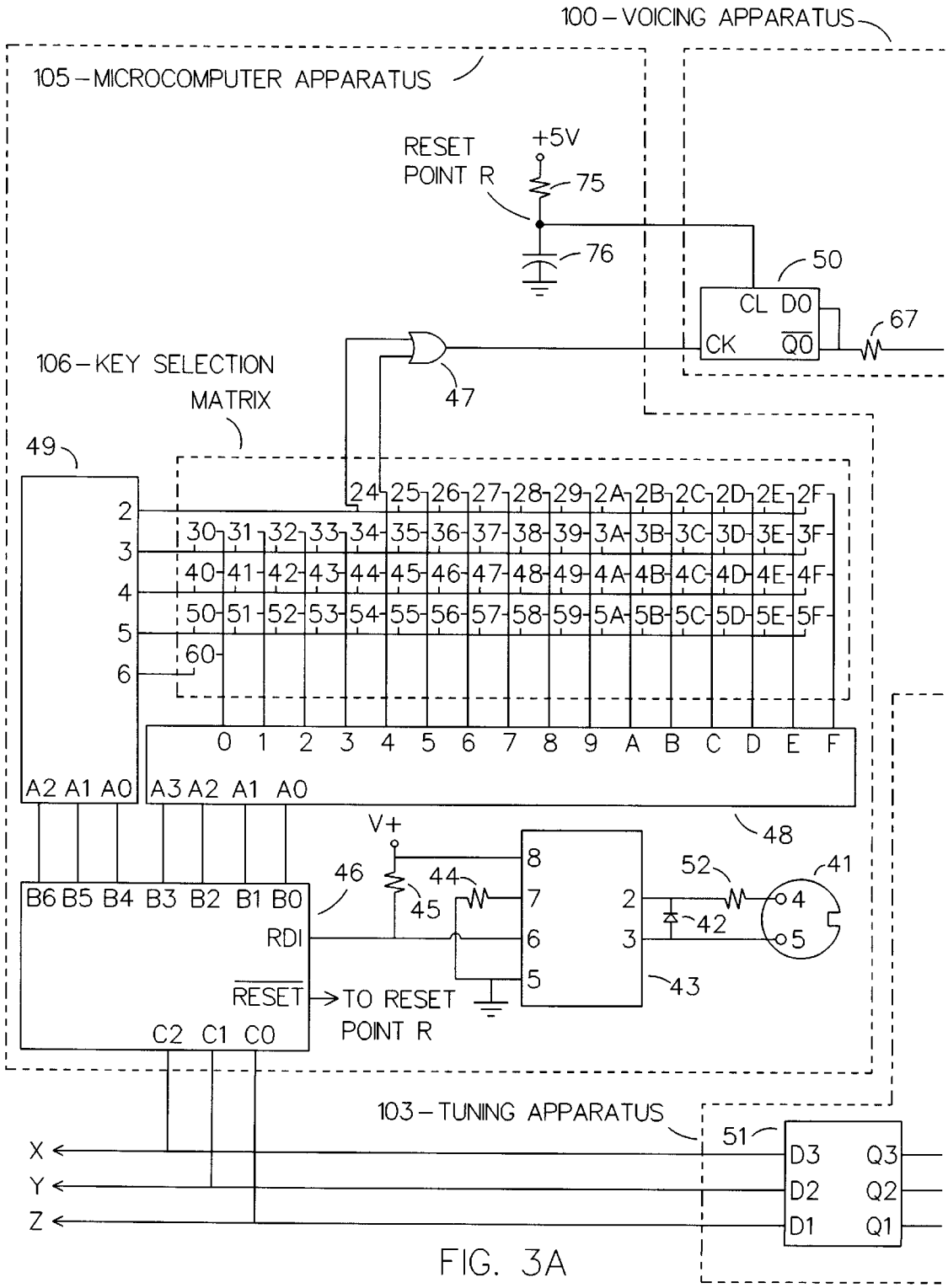
FIG. 3A and FIG. 3B is a circuit diagram of the invention apparatus.
Figure 3B:
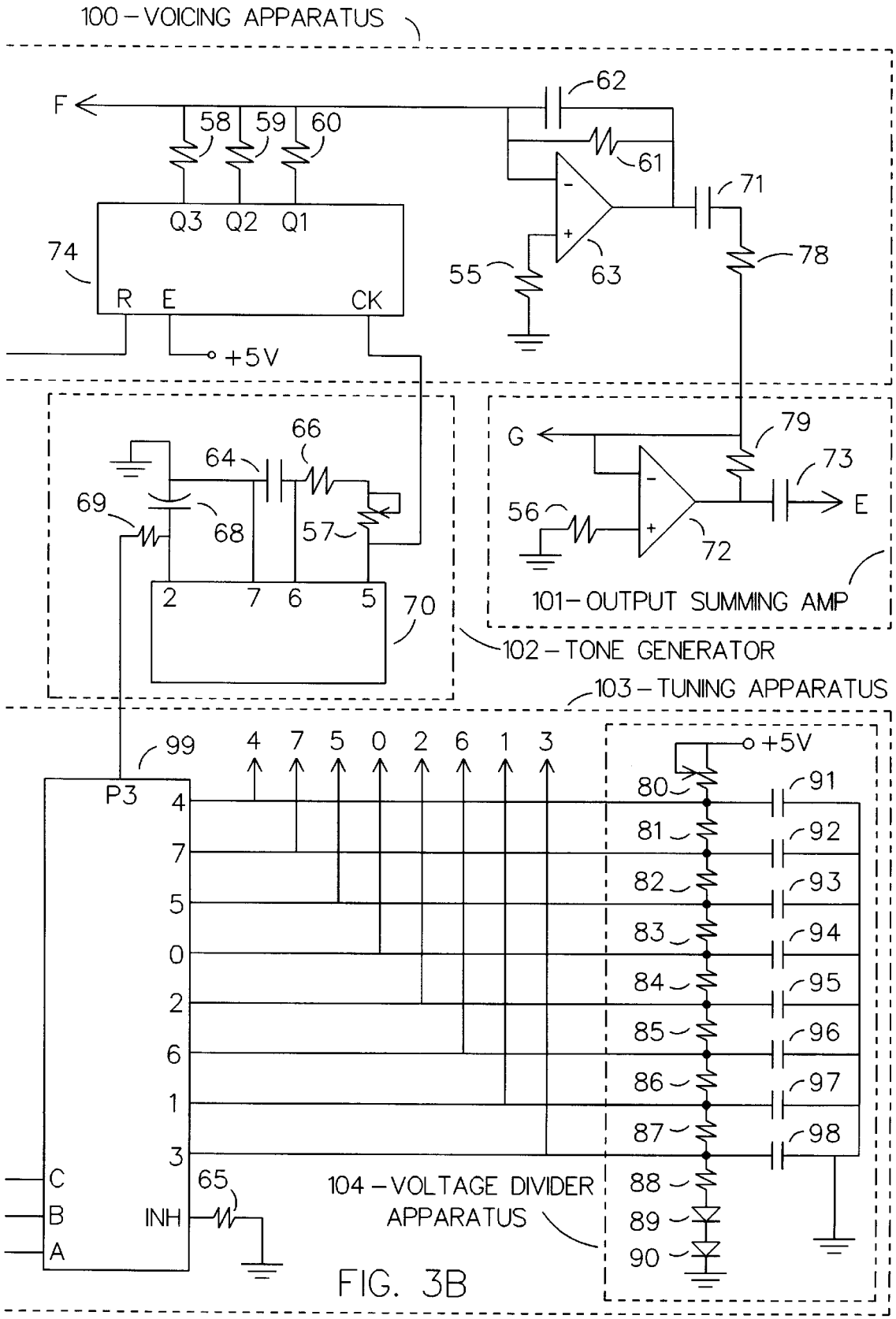

FIG. 3A and FIG. 3B form a single, complete view that is used to describe various units of the invention circuit apparatus and how they connect together including: (a) a microcomputer apparatus 105 with a key-selection matrix 106 for all notes, (b) a voicing apparatus 100 for a MIDI note $24, (c) a tuning apparatus 103 for MIDI note $24, (d) a tone generator 102 for MIDI note $24, (e) an audio summing amp 101 for the output of voicing apparatus 100 and the voicing apparatus output of other notes, and (f) a voltage-divider apparatus 104 for tuning apparatus 103 with connection points for the tuning apparatus of other notes.

The MIDI keyboard sends a MIDI binary-code signal, from a MIDI output DIN connector, in a serial format, one bit after another, using a MIDI sending unit with an open collector transistor switch that switches current on and off according to the bits that are transmitted.

Referring to FIG. 3A, the MIDI signal-code current enters microcomputer apparatus 105 at a pin 4 of a DIN connector 41 from a serial-cable connection to a +5 volt source in the MIDI sending unit of the keyboard or key sequencer. A 220 ohm pull-up resistor 52 is connected from pin 4 of DIN connector 41 to a pin 2 of a 6N138 optoisolator integrated circuit 43. A 6N138 data sheet from the integrated-circuit supplier, will show that there is a light-emitting diode connected internally from pin 2 to a pin 3 with the anode at pin 2. From pin 4 of DIN connector 41, the signal-code current enters pin 2 of the 6N138 and exits at pin 3. A 1N914 protection diode 42 connects externally from pin 3 to pin 2 of the 6N138 with the anode at pin 3. The signal current continues from pin 3 of the 6N138 to a pin 5 of DIN-connector 41 and back through the serial cable to the open collector of the MIDI sending unit.

The data sheet also shows that the light emitting diode of the 6N138 illuminates a phototransistor in the 6N138 to switch on and off according to the binary signal and that the phototransistor is connected to another internal transistor in a darlington configuration to boost current capacity at a pin 6 open-collector output. At the 6N138 output is a 4.7 k bias resistor 44 with one end connected to a pin 7 and the other end connected to a ground connection at a pin 5 and a 10 k pull-up resistor 45, with one end connected to a V+ and a pin 8 and the other end connected to output pin 6 of the 6N138. Pin 6 is also connected to an RDI input of a MC68HC705C8A microcomputer 46. An isolated binary-code signal from pin 6 of the 6N138 goes to the RDI, which is a bit 0 of a port D of microcomputer 46 and is programmed as a Serial-Communication-Interface input.

The binary code signal from pin 6 of the 6N128 is optically isolated to prevent ground loops and glitches from crashing a computer program in the middle of a musical performance, which is more likely when many MIDI instruments are connected to a binary code signal.

Terminal pins of integrated circuits in FIG. 3A and FIG. 3B are identified either by a pin number, by a pin function, or by a gate symbol to accomodate whatever method is best suited to show how different parts relate to one another. The manufacturer's data sheets can be used to easily correlate this information.

Microcomputer 46 output ports are identified by bit numbers with a prefix B for a port B and a prefix C for a port C. The pins for unused bits at microcomputer ports are not shown and are assumed connected by pull-up resistors to a +5 volt supply. The MC68HC705C8A is from the Motorola M68HC05 family of microcomputers, also called microcontrollers, and details for crystal connections, pin identification, and programming are available in the M68HC05 Applications Guide from the Motorola Website or the Motorola Literature Center in Phoenix, Ariz.

The MIDI serial binary code signal at the RDI input is converted to an 8-bit parallel binary format required for computer processing and for the program to sort out key selection and velocity values, which, in accordance with the MIDI specification, are called Data bytes and have a most significant bit of 0.

The program makes a note-on key selection list to determine the respective tuning-correction values to be used and then substitutes the correct tuning codes for the respective velocity values in the list. Key velocity is not necessary for non-percussive voicing apparatus and is only needed to identify note-off key selection, which has a binary 00000000 velocity code number.

Key-selection note-off values are not listed. Instead, as each note-off key number is identified in the binary signal, it is sent to the key-selection matrix of the microcomputer apparatus at port B to turn off the note.

In FIG. 3A, the microcomputer apparatus connected to port B is a 3-to-8 line 74HC138 decoder integrated circuit 49 with three addressable input bit numbers identified by a prefix A and also connected to port B is a 4-to-16 line 74HC154 decoder integrated circuit 48 with four addressable input bit numbers also identified with a prefix A.

Respective connections from microcomputer 46 to decoder 49 are from a bit B6 to a bit A2, a bit B5 to a bit A1, and a bit B4 to a bit A0. Respective connections from microcomputer 46 to decoder 48 are from a bit B3 to a bit A3, a bit B2 to a bit A2, a bit B1 to a bit A1, and a bit B0 to a bit A0.

A MIDI 8-bit Data byte outputs as a 7-bit binary code from port B using bits B6 to B0 inclusive of microcomputer 46. Bit B7 of port B is zero for MIDI data bytes and is not required as an output and is not shown.

A MIDI binary key number at the addressable inputs of the decoders selects a corresponding hexadecimal output line number by turning it from a high to a low logic level. Key numbers are the same as note numbers in terms of reference.

FIG. 3A shows an output line number 2 to 6 of decoder 49 as a first digit and output line number 0 to F of decoder 48 as a second digit of key numbers $24 to $60 in key selection matrix 106. The $ sign is left off matrix numbers for clarity. Key numbers in the matrix identify decoder connections for 61 OR gates that are used to turn the respective voicing apparatus of each note on and off.

FIG. 3A and FIG. 3B illustrates a typical circuit for one note of the invention apparatus starting with an OR gate connection for a MIDI key number $24 to the key selection matrix. The matrix also shows similar OR gate connection points for key numbers $25 to $60. For MIDI key number $24, a first input of a 2-input OR gate 47 from a 74HC32 integrated circuit is connected to a horizontal output line 2 of the 3-to-8 line decoder 49, and a second input of the OR gate is shown connected to a vertical output line 4 of the 4-to-16 line decoder 48.

The output of OR gate 47 is at a low logic level only when both inputs are low. Both inputs are low only when the binary equivalent of key number $24 is at the decoder inputs. Key numbers $25 to $60 turn similar OR gates on and off.

The output of OR gate 47 is connected to a clock input pin CK of a 74HC175 integrated circuit, which is part of voicing apparatus 100 in FIG. 3A. The 74HC175 integrated circuit has four flip-flops with a clear pin CL connected to a reset point R. A latch 50, made from one of the 74HC175 flip-flops, is wired to toggle on and off with CK as an input and with a bar Q0 pin connected to a D0 pin as an output. The output connects to a pull-up resistor 67.

Microcomputer connections at port C are to a 3-bit data bus connected to a storage register 51, made from the three remaining flip-flops of the 74HC175 integrated circuit. Respective connections from port C of microcomputer 46 to the data inputs of storage register 51, via the data bus, are from a bit C2 to a bit D3, a bit C1 to a bit D2, and a bit C0 to a bit D1. The storage register is the input of tuning apparatus 103 for a note $24 with data bus connections at points X, Y, and Z to the storage registers of tuning apparatus for other notes.

There are eight tuning correction codes identified by 8-bit binary numbers from 00000000 to 00000111 inclusive, which are substituted for velocity values in the note-on list and sent to output as a 3-bit binary code from port C.

The program outputs key number $24 on the key selection list by loading an ACCA register of the microcomputer with its binary value to store in port B, then loading ACCA with its binary tuning code to store in port C, and clearing ACCA to store zeros in port B. This procedure creates a short pulse of several micro-seconds duration at the output of OR gate 47. The pulse toggles latch 50 at the trailing edge of the pulse when it goes from a low to high logic level. In the same integrated circuit, the pulse also latches the tuning code at the output of port C and data bus input of register 51 to the output of register 51.

The outputs of register 51 in FIG. 3A connect to the addressable inputs of a 4051 multiplexer integrated circuit 99 in FIG. 3B. The respective connections are from a bit Q3 to a bit C, a bit Q2 to a bit B, and a bit Q1 to a bit A.

A binary value at the CBA addressable inputs of multiplexer 99 selects an equivalent decimal or hexadecimal input line from 0 to 7 inclusive. Decimal and hexadecimal numbers of 3-bit binary values are the same. Corresponding pin numbers of input lines can be found in Motorola data books. A binary selected input line switches a correction voltage from voltage divider apparatus 104 to a pin 3 output line, shown as P3 in multiplexer 99.

Respective connections from the numbered inputs of multiplexer 99 to the voltage divider apparatus are from:

(a) an input number 4 to a junction connection of a resistor 81, a capacitor 91, and a potentiometer 80, (b) an input number 7 to a junction connection of a resistor 82, a capacitor 92, and resistor 81, (c) an input number 5 to a junction connection of a resistor 83, a capacitor 93, and resistor 82, (d) an input number 0 to a junction connection of a resistor 84, a capacitor 94, and resistor 83, (e) an input number 2 to a junction connection of a resistor 85, a capacitor 95, and resistor 84, (f) an input number 6 to a junction connection of a resistor 86, a capacitor 96, and resistor 85, (g) an input number 1 to a junction connection of a resistor 87, a capacitor 97, and resistor 86, (h) an input number 3 to a junction connection of a resistor 88, a capacitor 98, and resistor 87, Looking at FIG. 3B to complete the connections of the voltage-divider apparatus, a top terminal and also an adjustment terminal of potentiometer 80 are connected to the +5 volt supply. A bottom end of resistor 88 is connected to an anode end of a temperature-compensation diode 89. A cathode end of diode 89 connects to an anode end of a temperature-compensation diode 90. A cathode end of diode 90 connects to ground. Each decoupling capacitor, 91 to 98 inclusive, is also polarized so that a positive end is at the junction connection with a distal negative connection to the ground.

To complete the output connection of multiplexer 99, a 120 kilohm bias resistor 69 is connected from output pin 3 of multiplexer 99 to a pin 2 of a phase-locked-loop integrated circuit 70 to transfer a correction-bias voltage to a voltage-controllable input of the loop circuit at pin 2.

For the correct operation of tuning apparatus, voltage-divider resistor numbers and values are listed below in a Part No. and Ohms column. Output voltages at ohmic divider junctions are listed in a Volts column. Corresponding tuning corrections at multiplexer inputs are listed in a Correction and Input column. The musical interval that it corrects is listed in an Interval column.

| Part No. | Ohms | Volts | Correction | Input | Interval |
|---|---|---|---|---|---|
| 80 | 380 | 4.05 | −15 cents | 4 | 3rd and 6th |
| 81 | 20 | 4.00 | −12 cents | 7 | 7th |
| 82 | 60 | 3.85 | −3 cents | 5 | 4th and Minor 7th |
| 83 | 20 | 3.80 | 0 cents | 0 | 1st |
| 84 | 20 | 3.75 | +3 cents | 2 | 2nd and 5th |
| 85 | 40 | 3.65 | +9 cents | 6 | Dim 5th |
| 86 | 20 | 3.60 | +12 cents | 1 | Semitone |
| 87 | 20 | 3.55 | +15 cents | 3 | Minor 3rd and Minor 6th |
| 88 | 920 | | | | |

The divider-voltage values connect to other multiplexer inputs identified at arrow points 4, 7, 5, 0, 2, 6, 1, and 3 in tuning apparatus 103 of FIG. 3B. The divider-resistor values listed with the 120 kilohm bias resistor 69 are suitable for connecting to all of the multiplexers of one tone-generator board described in FIG. 2, or other values can be scaled or chosen to suit a particular design preference. For example, larger values for components can produce larger operational time constants for slower response times and vice versa. Polarized decoupling capacitors for the divider should be electrolytic or dipped tantalum with a value of about 3.3 microfarads to filter out any stray frequency coupling at the divider junctions.

The voltage divider apparatus is set up for operation with potentiometer 80 measuring about 380 ohms with the power off and adjusting the potentiometer to precisely 3.80 volts at the 0 input of the multiplexer with the power on. A two kilohm, 15-turn cermet trimpot is suitable for all apparatus potentiometers.

Referring to components of tone generator 102 in FIG. 3B, part 70 is a 567 phase-locked-loop integrated circuit, which is preferred as a musical tone generator because of its general-purpose adaptability and low cost, although many other types are available. An excellent reference for phase-locked-loop integrated circuits and their application is a Linear Data Handbook available at Signetics Co., 811 East Arques Ave., Sunnyvale, Calif. 94088-3409.

All frequency adjustments of the tone generator are made with all registers reset when the power supply is turned on. When all registers are reset, a binary 000 is at the addressable inputs of the multiplexer, which causes 3.80 volts at the 0 input to be connected to bias resistor 69.

The frequency of the 567 is determined by external resistive and capacitive components of an internal oscillator controlled by the loop voltage gain. Bias resistor 69 adjusts the loop voltage gain for small changes in frequency. The tempered-scale, free-running frequency of the loop is set by disconnecting bias resistor 69 as a source of frequency control with a manual connection from an INH pin of the multiplexer to the +5 volt supply, which turns off all multiplexer switches. Normally, the INH pin connects to ground with a resistor 65.

With all multiplexer switches turned off by the INH pin, the free running frequency is set with a tuning potentiometer 57, which in the diagram of tone generator 102, has a bottom terminal connected to a pin 5 of the 567 part 70.

An adjustment terminal and a top terminal of potentiometer 57 connect to one end of a tuning resistor 66 with the other end of resistor 66 connected to a pin 6. A polyester-film, tuning capacitor 64 connects from pin 6 to a ground at a pin 7. Before tuning can begin, however, a polarized tantalum capacitor 68, which is the low-pass filter of the phase-locked-loop, is connected from a pin 2 with a negative end to ground. See Signetics Handbook for formulas to calculate frequency and low-pass capacitor values and an explanation of loop parameters.

For fast operation with components of smaller size and lower cost, the tempered-scale frequency of tone generator 70 is tuned to sixteen times the musical frequency of the fundamental note generated by voicing apparatus 100. Accordingly, a value of about 0.1 microfarads for low-pass capacitor 68 is satisfactory for all tone generator frequencies required for keyboard voicing, and bandwidth parameters are not used in tone-generator applications.

Once the free-running frequency is set, the jumper cable is disconnected from the INH pin of the multiplexer to reconnect 3.80 volts to bias resistor 69. The voltage-feedback gain of the 567 oscillator will also be approximately 3.80 volts for the tempered-scale free-running frequency. Tuning potentiometer 57 can then be readjusted to the exact tempered-scale frequency again to correct for possible slight voltage differences. Other tone generators connected to the same voltage divider are tuned in a similar manner.

With respect to the pitch of tempered-scale notes, it is a tendency of human hearing for frequencies below 100 Hz to sound higher and frequencies above 1000 Hz to sound lower than the actual tuned frequency. To compensate for human hearing errors, treble octaves are stretched upwards and bass octaves are stretched downwards by gradually sharpening or flattening the respective notes.

For piano tuners, who tune and test tempered-scale octaves by counting beat frequencies, the correct compensation usually happens automatically. Electronic tuners can also be used to verify compensation. For five-octave keyboards, the tempered-scale treble frequencies from MIDI note F77 to C84 should be stretched sharp by 5 cents and from note C84 to C96 inclusive by 10 cents. The bass octave from MIDI key C48 to C36 inclusive should be stretched flat by 5 cents.

Required compensation for a five-octave keyboard does not significantly affect corresponding natural-scale correction values, which are also based on how the pitch of the tempered scale is perceived. Because the tempered scale is essentially out of tune, stretch-tuned octaves tends to become exaggerated with keyboard scales of seven octaves or more, as musicians try to compensate for greater hearing discrepancies and the tempered-scale errors at the same time. This problem can be eliminated by combining the correct amount of compensation for hearing errors with natural-scale tuning corrections.

In FIG. 3B the output of tone generator 102 is a square-wave, tuned frequency from pin 5 of phase-locked-loop 70, which connects to a clock input CK of a frequency divider 74 in voicing apparatus 100. A binary counter is used as a frequency divider and is part of a 4520 dual integrated-circuit package. A divide by two output at a pin Q0 is not used and is not shown. A pin Q1 is a divide by four frequency output and a pin Q2 is a divide by eight frequency output. These frequencies are combined as harmonics with the lowest frequency from a pin Q3, which is a divide by sixteen output.

A reset pin R of the divider is connected to pull-up resistor 67 from the bar Q0 output of latch 50 in voicing apparatus 100 of FIG. 3A. An enable pin E of the divider connects to +5 volts so that reset pin R can act as a divider-voicing on-and-off switch with the output from latch 50.

All clear pins for resetting latches and storage registers are connected to reset point R of microcomputer apparatus 105 in FIG. 3A. Reset point R is at a junction connection of a resistor 75 and a polarized capacitor 76, which forms a reset circuit with resistor 75 making a distal connection to the +5 volt supply and with a negative end of capacitor 76 connected to ground. A bar RESET pin of the microcomputer also connects to reset point R. The bar over RESET indicates the RESET pin is active at a low logic level so that the computer and all of the flip-flops for latches and storage registers reset when the power is first turned on and capacitor 76 begins to charge from a low to high logic level.

In FIG. 3B, a voice-summing resistor 58, 59, and 60 connect at one end to divider output pins Q3, Q2, and Q1 respectively with a distal connection from each resistor to a negative input of a voice-summing amplifier 63. At the negative input of amplifier 63, resistor outputs for divider 74 can be summed together with resistor outputs of other dividers on the same tone-generator board. The other divider resistors can connect at a point F.

one end of a coupling resistor 73. The other end of coupling resistor 73 connects to the input of a conventional audio amplifier channel at E. A bias resistor 56 connects from a positive input of amplifier 72 to the ground. The output-summing resistors of other tone generators from other boards connect at G. General-purpose operational amplifiers from a 1458 dual op-amp integrated circuit may be used for amplifiers 63 and 72.

Unused pins of the 567 integrated circuit are left unconnected while all unused pins of CMOS or HCMOS integrated circuits must connect to +5 volts with a pull-up resistor or be grounded.

Flowcharts for the natural-scale tuning program and a step by step explanation thereof is included in the specification. All branch instructions refer to the microcomputer CCR or SCSR status register bits. The program uses a Motorola M68HC05 instruction set to sort out and modify the MIDI binary code.

The natural-scale tuning program is for non-percussive voicing apparatus and demonstrates unique step sequences of a tuning method that could be incorporated in a variety of programs to correct tuning to the natural scale by using the tempered scale as a reference. The first note of a key list prepared by the program is used as a tempered-scale reference to correct tuning of other notes on the list.

To correct tuning in the best order, simultaneous key selection should be transmitted from the lowest note to the highest note. If not transmitted this way, the program will still correct tuning with whatever note is first on the list as a tempered-scale reference.

EXPLANATION OF FLOWCHART STEPS OF THE NATURAL-SCALE TUNING PROGRAM

START PART 1. MAKE A NOTE-ON KEY-SELECTION LIST.

0172 LDX #$53 Address Mode IMM Machine Code ae 53

A LDX instruction loads an index register, XR, with an immediate value $53 to start the note-on key-selection list at address $53 for a program start-up.

LOOK FOR A NOTE-ON STATUS BYTE:

0174 BRCLR5 RDRF = 1? Address Mode DIR Machine Code Ob 10 fd

A gain resistor 61 and a low-pass capacitor 62 connect from the negative input to the output of amplifier 63. Low-pass capacitor 62 filters the sound at the output of amplifier 63 for the desired timbre. A bias resistor 55 connects from a positive input of amplifier 63 to ground. The output of amplifier 63 is connected to one end of a coupling capacitor 71, the other end of which makes a series connection to an output-summing resistor 78. The output-summing resistor has a distal connection to a negative input of an output-summing amplifier 72 with associated parts identified together as output summing amp 101.

A gain resistor 79 connects from the negative input of amplifier 72 to the amplifier output where it also connects to RDRF indicates when an RDR, Receive Data Register, is full. To make the note-on key-selection list, the program begins by looking for the Note-on Status byte by monitoring the MIDI bytes in the RDR as they are received.

A BRCLR5 instruction tests an RDRF bit 5 of an SCSR, Serial Communication Status Register and branches if the bit is clear. When RDRF=0, the RDR isn't full, and BRCLR5 keeps branching back to see when it's full. The RDR is a programmed function of an SCDR, Serial Communication Data Register. It can also be used as a TDR, Transmit Data Register. When the RDR is full, bit 5 of the SCSR, is set and the program proceeds to the next step.

0177 LDA SCDR Address Mode DIR Machine Code b6 11

When the RDR is full, LDA loads the accumulator with the contents of the RDR, which is actually the SCDR configured as a RDR.

-continued

| | | | |
|---|---|---|---|
| 0179 | CMP 4$90 | Address Mode IMM | Machine Code al 90 |
| | CMP compares the accumulator value with the immediate value #$90, which is the code number for a Note-on Status byte. | | |
| 017B | BNE if Z = 0 | Address Mode REL | Machine Code 26 f7 |

BNE tests the Z bit in the CCR-Condition Code Register. If Z=0, the previous CMP arguments are not equal, a Note-on Status byte is not in the accumulator, and BNE branches back to STATUS to check another byte. If Z=1, a Note-on Status byte is in the accumulator and BNE goes to next step.

| LOOK FOR A DATA BYTE: | | | |
|---|---|---|---|
| 017D | BRCLR5 RDRF = 1? | Address Mode DIR | Machine Code Ob 10 fd |
| | BRCLR5 checks to see if the RDR is full to look for the Data Bytes of the Note-On Status byte. | | |
| 0180 | LDA SCDR | Address Mode DIR | Machine Code b6 11 |
| | The SCDR is the RDR. LDA loads ACCA with contents of RDR. | | |
| 0182 | BMI if N = 1 | Address Mode REL | Machine Code 2b 25 |

A bit 7 of a negative binary number and a Data byte is 0. In the CCR, a negative bit, N, is set if bit 7 of the number in ACCA is 0. A BMI instruction tests the negative bit, N, and branches if N is set by the Data byte in ACCA. If N=0, BMI goes to the next step to determine if the number in ACCA is one of six Status bytes that can cancel a Note-On Running Status that has been initiated by the Note-on Status code number.

| SEE IF THE NOTE-ON RUNNING STATUS IS CANCELLED: | | | |
|---|---|---|---|
| 0184 | CMP #$A0 | Address Mode IMM | Machine Code a1 a0 |
| | CMP compares ACCA with $A0, a code number of a Key Pressure Status byte. To compare ACCA with a number means comparing the value in ACCA with a number. | | |
| 0186 | BEQ if Z = 1 | Address Mode REL | Machine Code 27 ec |
| | A BEQ instruction tests the Z bit of the CCR and if Z = 1, causes a branch to STATUS to get the next Note-on Status byte. If Z = 0, its not a Key Pressure Status byte and BEQ goes to the next step. | | |
| 0188 | CMP #$B0 | Address Mode IMM | Machine Code a1 b0 |
| | CMP compares ACCA with $B0, a Control-Change Status-byte code number. | | |
| 018A | BEQ if Z = 1 | Address Mode REL | Machine Code 27 e8 |
| | If Z = 1, the two numbers compared at the previous step are equal and BEQ branches to get the next Note-On Status byte or goes to the next step if Z = 0. | | |
| 018C | CMP #$C0 | Address Mode IMM | Machine Code a1 c0 |
| | CMP compares ACCA with $C0, a Program-Change Status-byte code number. | | |
| 018E | BEQ if Z = 1 | Address Mode REL | Machine Code 27 e4 |
| | If Z = 1, the two numbers compared at the previous step are equal and BEQ branches to get the next Note-On Status byte or goes to the next step if Z = 0. | | |
| 0190 | CMP #$D0 | Address Mode IMM | Machine Code a1 d0 |
| | CMP compares ACCA with $D0, a Channel-Pressure Status-byte code number. | | |
| 0192 | BEQ if Z = 1 | Address Mode REL | Machine Code 27 e0 |
| | If Z = 1, the two numbers compared at the previous step are equal and BEQ branches to get the next Note-on Status byte or goes to the next step if Z = 0. | | |
| 0194 | CMP #$E0 | Address Mode IMM | Machine Code a1 e0 |
| | CMP compares ACCA with $E0, a pitch-Wheel Status-byte code number. | | |
| 0196 | BEQ if Z = 1 | Address Mode REL | Machine Code 27 dc |
| | If Z = 1, the two numbers compared at the previous step are equal and BEQ branches to get the next Note-on Status byte or goes to the next step if Z = 0. | | |
| 0198 | CMP #$F0 | Address Mode IMM | Machine Code a1 f0 |
| | CMP compares ACCA with $F0, a System-Exclusive Status-byte code number. | | |
| 019A | BEQ if Z = 1 | Address Mode REL | Machine Code 27 d8 |
| | If Z = 1, the two numbers compared at the previous step are equal and BEQ branches to get the next Note-on Status byte or goes to the next step if Z = 0. | | |
| 019C | CMP #$00 | Address Mode IMM | Machine Code al 00 |
| | CMP compares ACCA with $00 to see if its a note-off velocity value of a note-on key number. | | |
| 019E | BNE if Z = 0 | Address Mode REL | Machine Code 26 DD |

If Z=0, the previous CMP values are unequal. BNE then branches to check another value for the note-on list. If Z=1, the previous CMP values are equal, ACCA has the note-off velocity value, and BNE goes to the next step.

| OUTPUT A NOTE-OFF KEY NUMBER: | | |
|---|---|---|
| 01A0 DECX | Address Mode INH | Machine Code 5a |
| A DECX instruction decrements the XR to access the note-off key number for output to Port B. The note-off address is then rewritten by the next entry. If the last entry listed is the note-off key number, it is rewritten by an EOL, end of list marker, so that only note-on values remain on the list. | | |
| 01A1 LDA ,X | Address Mode IX | Machine Code f6 |
| LDA loads ACCA with the note-off key number in the list. | | |
| 01A2 STA PORTB | Address Mode DIR | Machine Code b7 01 |
| STA outputs the note-off key number in ACCA by storing it in Port B. | | |
| 01A4 CLRA | Address Mode INH | Machine Code 4f |
| A CLRA instruction clears ACCA by loading it with $00. | | |
| 01A5 STA PORTB | Address Mode DIR | Machine Code b7 01 |

STA stores ACCA value $00 in Port B. A flip-flop latch 50 in FIG. 3A is used to demonstrate how a key number $24 that is assumed to have been toggled on is turned off. To turn off key number $24, note-off key-number $24 is stored in Port B, which causes the output of OR gate 47 in FIG. 3A to go from a high to low logic level. Then, storing $00 in Port B causes the output of OR gate 47 to go back to its previous high logic level and create a low to high transient pulse, which is the required transition to toggle flip-flop latch 50 off.

| | | |
|---|---|---|
| 01A7 BRA | Address Mode REL | Machine Code 20 D4 |
| BRA branches to get another Data byte. | | |
| LIST NOTE-ON VALUES | | |
| 01A9 STA ,X | Address Mode IX | Machine Code f7 |
| STA stores the note-on data byte into the note-on list at indexed address. | | |
| 01AA INCX | Address Mode INH | Machine Code 5c |
| An INCX instruction increments the XR to next address in note-on list. | | |
| 01AB BRCLR4 IDLE = 1? | Address Mode DIR bit4 | Machine Code 09 10 cf |

IDLE=1 indicates that a bit 4 of the SCSR is set when 10 consecutive logic ones appear in the SCDR. Bit 4 clears by reading the SCDR. If IDLE=0, key selection has not stopped and BRCLR4 branches to get another MIDI byte. If IDLE=1, the system is idling and BRCLR4 goes to the next step.

| MARK END OF LIST: | | |
|---|---|---|
| 01AE LDA #$BE | Address Mode IMM | Machine Code a6 be |
| LDA loads ACCA with an immediate value $BE, the end of list or EOL marker. | | |
| 01B0 STA ,X | Address Mode IX | Machine Code f7 |
| STA stores the EOL marker at the end of the list. | | |
| PART 2. MODIFY LIST FOR TUNING. | | |
| CONVERT KEY NUMBERS TO INTERVALS: | | |
| 01B1 LDX #$51 | Address Mode IMM | Machine Code ae 51 |
| LDX loads the XR to point to an address $51, which determines the start of a loop, at a step 01b3 to follow, which moves the XR through the key list. | | |
| 01B3 INCX | Address Mode INH | Machine Code 5c |
| INCX points the XR to a velocity address of the list. | | |
| 01B4 INCX | Address Mode INH | Machine Code 5c |
| INCX points the XR to an indexed address of a key number on the list. | | |
| 01B5 LDA ,X | Address Mode IX | Machine Code f6 |
| LDA loads ACCA with the key number at the indexed address on the list. | | |
| 01B6 CMP #$BE | Address Mode IMM | Machine Code al be |

-continued

CMP compares ACCA with a number $BE, an EOL, end of list marker.

01B8 BEQ if Z = 1 Address Mode REL Machine Code 27 21

If the previous comparison is equal, the Z bit in the CCR is set, the number in ACCA is the EOL, and BEQ branches to Part 3. If the previous comparison is not equal, the Z bit is clear, the ACCA value is a key number to be converted to an interval, and BEQ goes to the next step to begin the conversion process.

01BA SUB $53 Address Mode DIR Machine Code b0 53

At a step 01BA, the program utilizes a novel method of tuning key selection to the natural scale by using the first note of a key-selection list as a tempered-scale reference for tuning the rest of the notes on the list to the natural scale with a unique program sequence of steps which comprise:

(a) subtracting the first key number of the key-selection list from itself and subsequent key numbers on the list, and reducing the resultant to a lowest octave, if necessary, to get a musical-scale interval number from 0 to 11, inclusive, with the 0 interval as the tempered-scale reference, and (b) matching the interval numbers to correction codes in a tuning offset table, (c) outputting the correction codes to correct the tuning of key-selected, tone-generator apparatus from the tempered scale to the natural scale.

To commence the tuning method, a SUB instruction at step 01BA subtracts the key number at address $53, which is the first key number in the note-on list, from the key number in ACCA, which is also loaded by starting from the first key number on the list, to get a resultant interval number in ACCA beginning with the 0 reference interval, which is tuned to the tempered scale.

When using SUB with a key selection list, it is possible for the first key number on the list to be bigger than subsequent key numbers. This happens when the first key number in a list of higher notes is held down while a note or chord is selected from lower keyboard notes. The result is an interval that is a negative number, which is negated to a positive number at a step 01BE in the program sequence before proceeding further.

01BC BPL if N = 0 Address Mode REL Machine Code 2a 01

A BPL instruction tests the N bit in the CCR and if it's clear, the resultant in ACCA is a positive number and BPL branches to bypass the negating procedure. If the N bit is set, the resultant is a negative number and the BPL goes to the next step to negate the negative binary number in ACCA to an equivalent positive number by substituting its twos complement in ACCA.

01BE NEGA Address Mode INH Machine Code 40

A NEGA instruction replaces the value in ACCA with its twos complement.

PROCESS INTVLS ALREADY IN LOWEST OCTAVE:

01BF CMP #$0C Address Mode IMM Machine Code al Oc

CMP compares the interval number in ACCA with $0C, which is 12 in decimal.

01C1 BHS if C = 0 Address Mode REL Machine Code 24 10

If the number in ACCA is higher or the same as $0C, a carry bit in the CCR will be clear and a BHS instruction branches to reduce the interval to a number from 0 to 11 inclusive. If already a number from 0 to 11 inclusive, the carry bit is set and BHS goes to a step 01C3.

GET TUNING TABLE:

01C3 STX TEMP Address Mode DIR Machine Code bf bf
A STX instruction stores the position of XR at a TEMP address $BF.
01C5 LDX #$A0 Address Mode IMM Machine Code AE AO
LDX loads XR with an address for the tuning offset table of the program.

MATCH KEYBD INTVL W/INTVL IN TABLE:

01C7 INCX Address Mode INH Machine Code 5c
INCX increments the XR to an interval number in the tuning table.
01C8 CMP ,X Address Mode IX Machine Code f1
CMP compares the interval number in ACCA with an interval number at an indexed, no-offset address in the tuning table.
01C9 BNE if Z = 0 Address Mode REL Machine Code 26 fc If the Z bit in the CCR is clear, the CMP values at a step 01C8 are not equal, the keyboard interval in ACCA is not identified, and BNE branches back to a step 01C7 to increment the XR and compare the next interval in the tuning table with ACCA. If the Z bit is set, the CMP values at step 01C8 are equal, the keyboard interval is identified, and BNE goes to a step 01CB.

GET TUNING CODE FROM OFFSET:

01CB LDA C,X Address Mode IX1 Machine Code e6 Oc
LDA loads ACCA with a tuning code number at an offset $0C of the tuning table, corresponding to the previously identified, keyboard interval.
01CD LDX TEMP Address Mode DIR Machine Code be bf
LDX loads the XR to point at the address of the previous position in the note-on key list, which is stored in TEMP.

REPLACE VELOCITY W/TUNING CODE

01CF STA 1,X Address Mode IX1 Machine Code e7 01
STA stores the tuning code number in ACCA at XR offset $01, which is the velocity address of the note-on key number that the XR is pointing to.
01D1 BRA Address Mode REL Machine Code 20 e0
BRA branches to TUNE to get the next key number in the note-on list.

REDUCE INTVL TO LOWEST OCTAVE:

01D3 SUB #$0C Address Mode IMM Machine Code a0 0c
BHS at a step 01C1 branches to a step 01D3 to subtract $0C from ACCA.
01D5 CMP #$0C Address Mode IMM Machine Code al Oc
CMP compares subtraction resultant with $0C, which is 12 in decimal.
01D7 BHS if C = 0 Address Mode REL Machine Code 24 fa If the resultant interval number in ACCA is higher or the same as $0C, carry bit C is clear and BHS branches back to step 01D3 to subtract $0C again. When the resultant interval number in ACCA is not higher or not the same as $0C, carry bit C is set, the interval in ACCA is in the lowest octave, and BHS goes to a step 01D9, which is to branch to 01C3 to get the interval tuning code and substitute it for the corresponding velocity code in the key list.

01D9 BRA Address Mode REL Machine Code 20 e8
BRA branches to step 01C3 to process the interval in ACCA.

PART 3. OUTPUT TUNING LIST.

01DB LDX #$51 Address Mode IMM Machine Code ae 51
LDX points the XR to address $51, the starting point for incrementing to address $53 or $55 to output the note-on key list.
01DD INCX Address Mode INH Machine Code 5c
INCX increments the XR by adding one to the contents.

-continued

| | | |
|---|---|---|
| 01DE INCX | Address Mode INH | Machine Code 5c |
| INCX increments the XR by adding one to the contents. | | |
| 01DF LDA ,X | Address Mode IX | Machine Code f6 |
| LDA loads ACCA with a key number from an indexed no offset address. | | |
| 01E0 CMP #$BE | Address Mode IMM | Machine Code al be |
| CMP compares ACCA with the immediate value $BE, the EOL marker. | | |
| 01E2 BEQ if Z = 1 | Address Mode REL | Machine Code 27 0b |

If the compared values at a step 01E0 are equal, the Z bit in the CCR is set, it's the end of the list, and BEQ branches to a step 01EF to get ready to start a new list. If the compared values are not equal, the Z bit in the CCR is clear, the value in ACCA is a key number, and BEQ goes to a step 01E4 to output the key number to Port B.

| | | |
|---|---|---|
| 01E4 STA PORTB | Address Mode DIR | Machine Code b7 01 |
| STA outputs the key number in ACCA to Port B. | | |
| 01E6 LDA 1,X | Address Mode IX1 | Machine Code e6 01 |
| LDA loads ACCA with a tuning code number at XR offset 01, which is the tuning code number for the previous key number at step 01E4. | | |
| 01E8 STA PORTC | Address Mode DIR | Machine Code b7 02 |
| STA outputs the tuning code number to a Port C. | | |
| 01EA CLRA | Address Mode INH | Machine Code 4f |
| CLRA loads $00 in ACCA. | | |
| 01EB STA PORTB | Address Mode DIR | Machine Code b7 01 |
| STA stores the ACCA value $00 in Port B, which creates a pulse that turns on a flip-flop for the key number at Port B and transfers the tuning value at Port C to a storage register of a tuning apparatus for the note-on key selected. | | |
| 01ED BRA | Address Mode REL | Machine Code 20 ee |
| BRA branches to get the next note-on key number in the list to output. | | |
| GET READY TO START A NEW LIST: | | |
| 01EF LDX #$53 | Address Mode IMM | Machine Code ae 53 |
| LDX loads the XR with value $53 to point at address $53 to start the list. | | |
| 01F1 JMP | Address Mode EXT | Machine Code CC 01 7D |
| JMP jumps to step 017D to start the note-on list at address $53. | | |

CONCLUSION, RAMIFICATIONS, AND SCOPE OF THE INVENTION

While the above description contains many specificities, these should not be construed as limitations on the scope of the invention, but rather as an exemplification of one preferred embodiment thereof.

Many other variations are possible. The natural scale tone-generator apparatus can also be used as a solo instrument with a dedicated keyboard that only transmits note-on and note-off Data bytes, and simultaneous key selection that is scanned from the lowest to the highest note.

To insure that there is always enough idling time to process a key selection list, another ramification could include program steps for an interrupt service routine to monitor key-selection input so that, after servicing the interrupt, control can then be returned to the interrupted tuning program.

Precisely how to write interrupt service routines is explained in Sydney B. Newel's Microcomputing 2/E textbook, published by John Wiley & Sons.

Figure 3C:
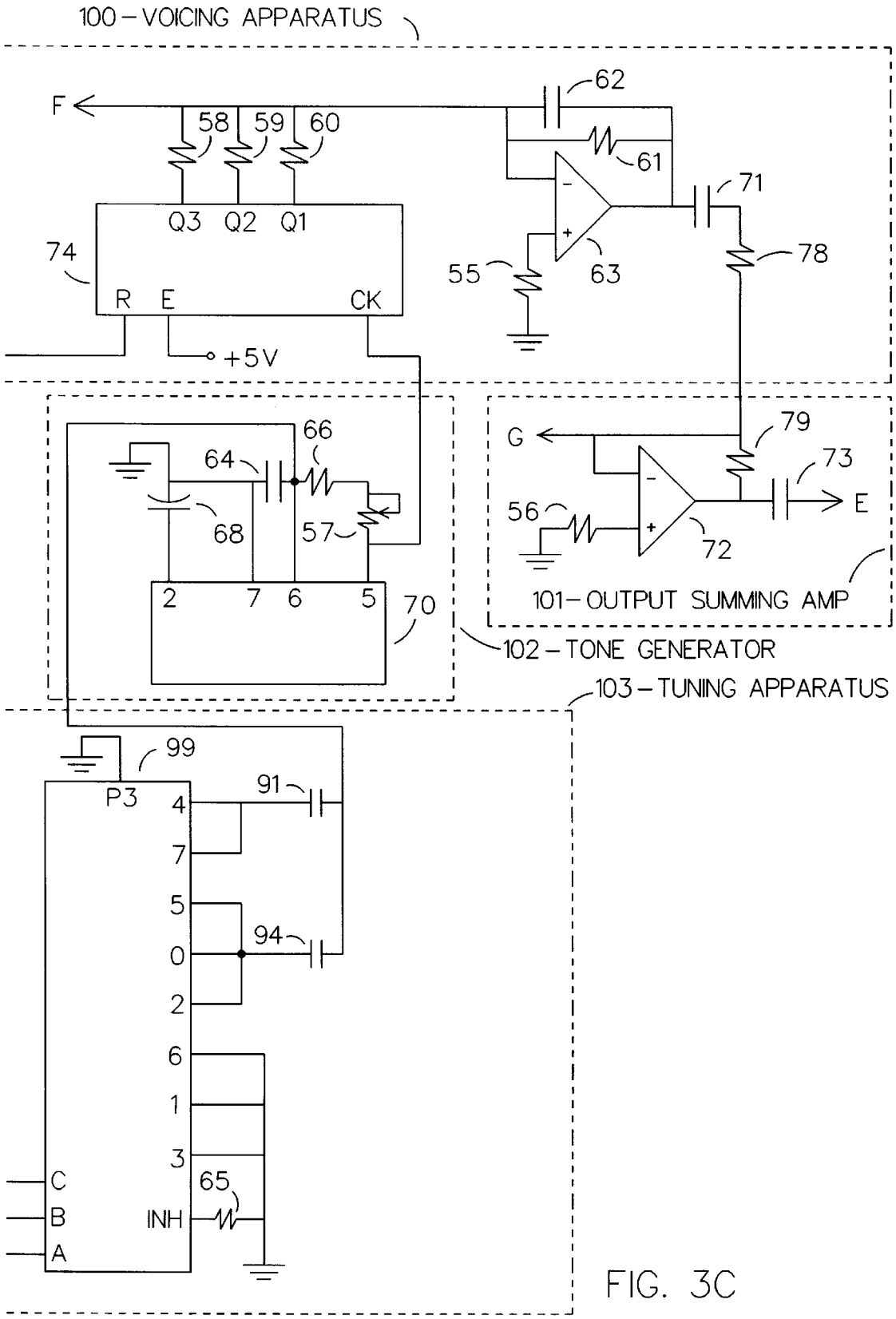
FIG. 3C shows a tuning-apparatus ramification of the invention.

FIG. 3C shows a tuning apparatus ramification of the subject invention where the tuning apparatus is limited to capacitive-tuning correction within four cents of a tempered scale reference frequency by leaving out the following components and reconnecting the remainder as follows:

(a) Voltage divider elements 80 to 90 inclusive and capacitor elements 92, 93, and 95 to 98 inclusive are omitted. The common terminal connection to the ground of capacitors 91 and 94 is then disconnected and reconnected to the tuning terminal of the respective electronic oscillator.

(b) The voltage bias resistor is then omitted and the switching output of the multiplexer is grounded.

(c) Multiplexer input switch 7 is connected to input switch 4. Multiplexer input switch 5 and 2 is connected to input switch 0, and multiplexer input switches 6, 1, and 3 are grounded.

The tempered-scale free-running frequency of each tone generator is then set +13 cents sharp for correcting the Dim 5th, Semitone, Minor 3rd, and Minor 6th intervals to the natural scale. Capacitor 94 lowers the free-running frequency to the exact tempered scale value for correcting the 1st, 2nd, 4th, 5th, and Minor 7th intervals to the natural scale. Capacitor 91 lowers the tempered scale frequency −14 cents to correct the 3rd, 6th, and 7th intervals to the natural scale.

Another possible program ramification could include using a bass note that is held down as a tempered scale reference to correct single notes, arpeggios, and chord selection to the natural scale.

As another ramification, unique percussive circuitry is added to a port A of the microcomputer so that the phase-locked-loop tone generators can lock on to a shifted-frequency burst corresponding to key velocity, which is sent to port A to create a very realistic type of percussive intonation for piano voicing. The shifted-frequency burst can be recorded on ordinary audio-cassette tape to form the basis of a cassette key sequencer with percussive playback.

In another ramification, the tuning process is applied to additional circuitry for digital algorithms of musical notes that can be accessed at the correct natural-scale frequencies required for key selection.

All home-computer sound cards have digital tone-generation and key-sequencing capability and a MIDI interface for connection to a MIDI keyboard. As another ramification, the natural-scale tuning process and digital algorithms described above could be incorporated into a sound card or separate extension card of a home computer for key replay in the natural scale. The serial communication interface of the MC68HC705C8A microcomputer, described on Page 12 and 13 of the specification, including the optoisolator and configuration for a baud rate of 31.250 kHz, is a MIDI interface similar to the MIDI interface of sound cards. A MIDI interface is necessary because the 31.250 kHz baud rate is too fast to be handled by a serial port of a home computer.

Because of the many possible variations of a preferred embodiment, the original prototype will be offered in kit form so that keyboard enthusiasts and experimenters can make program corrections to suit their own particular keyboard requirements and musical preferences. To supplement the MIDI implementation chart for a particular keyboard, the book, MIND OVER MIDI, described on Page 8, also includes a simple MIDI data analyzer program which can be used to determine what status bytes and data bytes are used, and how simultaneous key selection is transmitted. The program monitors the binary output of a MIDI keyboard and displays it on a computer screen in columns and rows of hexadecimal code.

Accordingly, the scope of the invention should be determined not by the embodiment illustrated, but by the appended claims and their legal equivalents.

I claim:

1. A method of operating a computer to execute a sequence of steps, which enable an object program to correct tuning of a binary-addressable tone-generator apparatus from the tempered scale to the natural scale according to key-selection signals of a MIDI keyboard, and with said sequence of steps comprising:

(a) making a key-selection list from a binary-coded signal of a MIDI musical-keyboard transmission, (b) using the first key number of said key-selection list as a tempered scale reference and subtracting said first key number from itself and subsequent key numbers of said key-selection list to obtain a respective interval number, (c) using the corresponding positive interval number for negative subtraction results, if necessary, (d) reducing said respective interval number to the lowest octave by subtracting twelve until the result is less than twelve, if necessary, (e) looking up a tuning correction code number corresponding to said respective interval number in a program offset table and putting said tuning correction code number in said key selection list, (f) outputting said key-selection list with tuning correction codes to the tone-generator apparatus.

2. The method of claim 1 wherein the computer is a Motorola MC68HC705C8A microcomputer.

3. The method of claim 1 wherein the binary-addressable tone-generator apparatus is the natural-scale tone-generator apparatus of the subject invention.

4. A natural-scale tone-generator apparatus having input connections to a conventional power supply, input connections to MIDI key-selection signals of a MIDI keyboard, and output connections to a conventional amplifier-speaker system, and with the tone-generator apparatus having a plurality of notes corresponding to the keys of the MIDI keyboard, and with the tone-generator apparatus responsive to a tuning method that corrects the tuning of MIDI key-selected notes of the tone-generator apparatus from the tempered scale to the natural scale, and with the tone-generator apparatus comprising in combination:

a voltage-controllable oscillator element as a respective, independently-tuneable tone generator for each note of the tone-generator apparatus, and with said oscillator element having terminals for tuning capacitors, resistive tuning components, filter components, and control-voltage access, and with the components connected so that said voltage-controllable oscillator can operate independently, and a respective, switching-multiplexer integrated-circuit element for each note, and with said multiplexer having a single output, at least three binary inputs, and a plurality of, at least, eight digitally-switchable inputs, and with a control-voltage bias resistor connected from the output of said multiplexer to the control-voltage-access terminal of said voltage-controllable oscillator, and a resistive voltage-divider element with the switchable inputs of said multiplexer connected to respective voltage levels at respective resistor junctions of said voltage divider, and with respective frequency decoupling capacitors connected from a ground of the power supply to the respective resistor junctions of the switchable inputs of said resistive voltage divider, and with said resistive voltage divider connected at one end through a voltage-level adjusting potentiometer to a positive voltage of the power supply, and with the other end of said resistive voltage divider connected through a pair of forward-biased, temperature-compensating diodes to the ground of the power supply, and with means for tuning said oscillator by digitally switching a voltage level value from the voltage-divider junctions to the control-voltage bias resistor of said voltage-controllable oscillator element with a binary code at the binary inputs of said multiplexer, and with the voltage level values of said resistive voltage divider connected to respective, switchable-multiplexer inputs of other notes, and a respective flip-flop integrated-circuit element, for each note, having a clock terminal, a clear terminal, and at least three flip-flops connected as a binary storage latch, and another flip-flop connected as a note on-off latch, and with the binary inputs of said multiplexer connected in a weighted manner to the outputs of the storage latch, and the clock terminal connected to the note on-off latch as an input, and with the storage latch actuated by the clock input of the note on-off latch, and with the clear terminal of said flip-flop integrated circuit connected to a conventional reset circuit for the tone generator apparatus, and a microcomputer element having, as a minimum, a parallel interface with a first and a second output port of, at least, eight-bit architecture, and with the storage latch of said flip-flop element for each note, having inputs connected to the first output port, in a weighted manner, starting at the lowest significant bit of the first output port of said microcomputer, and with said flip-flop element having means of transferring a binary tuning code from an output port of said microcomputer element to the addressable inputs of said multiplexer element, and with said microcomputer having a serial port with conventional software and hardware for a MIDI serial interface, and with the MIDI key-selection input signals connected to the serial interface, and a key-selection matrix element having, as unit parts, a 3-to-8 line decoder integrated circuit, a 4-to-6 line decoder integrated circuit, and a plurality of OR-gate integrated circuits, and with the second output port of said microcomputer connected, in a weighted manner, to the digital input lines of the 4-to-16 line decoder, starting from the least significant bit of the second output port, and with the 4-to-16 line decoder having hexadecimal output lines numbered 0 to F inclusive at vertical connection points of said matrix, and with the second output port connected in a weighted manner to the digital input lines of the 3-to-8 line decoder, and with the input lines of the 3-to-8 line decoder connected to the second output port with the least significant bit following the most significant bit of the 4-to-16 line decoder, and with the 3-to-8 line decoder having hexadecimal output lines numbered 2 to 6 inclusive at horizontal connection points of said matrix, and with the horizontal and vertical hexadecimal-digit lines of the decoders arranged to form said key-selection matrix, and with the horizontal and vertical hexadecimal-digit line numbers identifying at each intersection of said matrix a MIDI key number for a respective note and connection points for inputs of a respective OR gate, and with the output of the respective OR gate connected to the clock input of the respective note on-off latch for the respective note in said matrix, and a respective voicing element, for each note, having, as component parts, a frequency-divider integrated circuit with an on-off gate terminal, a voice-summing amplifier integrated circuit and associated resistors and capacitors for adjusting overall gain and tone quality, and with the output of the note on-off latch connected through a coupling resistor to the on-off terminal of the frequency-divider integrated circuit, and with a square-wave frequency output terminal of said voltage-controllable oscillator connected to a frequency-dividing input terminal of the divider integrated circuit, and with a plurality of divided frequencies at output terminals of the divider integrated circuit connected by respective voice-summing resistors to an inverting input of the voice-summing amplifier, and with the plurality of divided frequencies corresponding to a fundamental organ tone and harmonics, and with the inverting input of the voice-summing amplifier connected to the voice-summing resistors of other notes, and with the output of the voice-summing amplifier connected to one end of a coupling capacitor, and with the other end of the coupling capacitor connected to one end of an output-summing resistor, and an output-summing amplifier integrated-circuit component with the free end of output-summing resistors of all voice-summing amplifiers for one audio channel connected to a negative input of the output-summing amplifier, and with the output of the output-summing amplifier connected by a coupling capacitor to the conventional amplifier-speaker system, and with said key-selection matrix element having means of selecting a voicing element for a particular note by being presented with a key selection code, at it's binary inputs, from an output port of said microcomputer element, and with the voice-summing amplifiers and output-summing amplifier components providing means for summing the harmonic output of all of the voicing elements to the input channels of the conventional amplifier speaker system, and a tuning program element for the tuning method that corrects the tone generators of MIDI key selection to the natural scale, so that said microcomputer with said tuning program loaded in memory has means for programming the natural-scale tuning of the tone generators, actuated by the MIDI key-selection input signals, by outputting a key-selection signal to said key-selection matrix corresponding to a respective voicing element of each actuated tone generator, and outputting a corresponding tuning code to said respective storage latch of each actuated tone generator.

5. The natural-scale tone-generator apparatus of claim 4 wherein said voltage-controllable oscillator element is an oscillator element of phase-locked loop design.

6. The natural-scale tone-generator apparatus of claim 5 wherein said voltage-controllable oscillator element of phase-locked-loop design is the oscillator element of a 567 phase-locked-loop integrated circuit with a tuning potentiometer and a tuning resistor connected in series from a pin 5 to a pin 6, and with a tuning capacitor connected from the pin 6 to a pin 7 which is connected to the ground of the power supply, and with said voltage-control bias resistor element connected to a pin 2 which is the control-voltage-access terminal connection, and with a low-pass filter capacitor connected from the voltage-control-access terminal pin 2 to the ground of the power supply.

7. The natural-scale tone-generator apparatus of claim 4 wherein said switching-multiplexer element is a 4051 multiplexer integrated circuit having three binary inputs for selecting one of eight switchable inputs, and wherein said resistive voltage-divider has eight successive resistors connected in series between the voltage-level adjusting potentiometer and the temperature-compensating diodes, and with the switchable inputs arranged in a sequence of 4, 7, 5, 0, 2, 6, 1, and 3, for connection to successive resistor junctions of the eight successive resistors, and with the connections arranged so that input 4 of the sequence is connected to the resistor junction between the voltage-level adjusting potentiometer and the first resistor of the series, and so that input 3 of the sequence is connected to the resistor junction between the seventh and eighth resistor of the series.

8. The natural-scale tone-generator apparatus of claim 4 wherein said microcomputer element is a Motorola MC68HC705C8A microcomputer, and wherein a parallel Port C of the MC68HC705C8A microcomputer is connected to the inputs of the storage latches of said flip-flop integrated circuits, and wherein a parallel Port B of the MC68HC705C8A microcomputer is connected to the binary inputs of said key-selection matrix, and wherein a serial port is the RDI input of the MC68HC705C8A microcomputer which is configured to receive MIDI signals, and wherein the MIDI serial interface is a 6N138 opto-isolator integrated circuit which is connected from a pin 6 of the optoisolator to the RDI input of the MC68HC705C8A microcomputer, and with a pin 2 and a pin 3 of the optoisolator connected to a MIDI serial input-cable plug for receiving key-selection input signals, and wherein the reset terminal of the MC68HC705C8A microprocessor is connected to the conventional reset circuit of the tone-generator apparatus.

9. The natural-scale tone-generator apparatus of claim 4 wherein the conventional reset circuit is a resistor connected at one end to the positive voltage of the power supply and at the other end to the positive terminal of a polarized capacitor forming a junction for the reset terminal, and with the negative terminal of the capacitor connected to the ground.

10. The natural-scale tone-generator apparatus of claim 4 wherein capacitive components are used to make natural-scale tuning corrections to within 4 cents of a tempered scale reference frequency by omitting all of the divider components except the decoupling capacitors connected to switching inputs of said multiplexer element for binary codes numbers 4 and 0, and connecting the switching input of said multiplexer element for binary code number 7 to input 4, and connecting the switching inputs of said multiplexer element for binary code numbers 5 and 2 to input 0, and connecting the switching inputs of said multiplexer element for binary code numbers 6, 1, and 3 to the ground, and omitting the control-voltage bias resistor and connecting the output of said multiplexer element to the ground, and disconnecting the decoupling capacitors for switching inputs 4, and 0 at the ground connection and reconnecting them to the capacitor-tuning terminal of said oscillator element, and with the free-running frequency of each tone generator then set +13 cents sharp of the exact tempered-scale value for correcting the Dim 5th, Semitone, Minor 3rd and Minor 6th intervals to the natural scale, and with the value of capacitor 94 lowering the free-running frequency to the exact tempered-scale frequency for correcting the 1st, 2nd, 4th, 5th, and Minor 7th intervals to within 4 cents of the natural scale, and with the value of capacitor 91 lowering the tempered-scale frequency −14 cents to correct the 3rd, 6th, and 7th intervals to the natural scale, so that the tone generator apparatus is given means to capacitively tune said oscillator element by switching a capacitor-correction value with said multiplexer element from the capacitive-tuning terminal of said oscillator element to the ground.

* * * * *